US011486286B2

(12) United States Patent
Kurpejovic et al.

(10) Patent No.: US 11,486,286 B2
(45) Date of Patent: Nov. 1, 2022

(54) CONNECTION UNIT FOR AN EXHAUST GAS HEATER

(71) Applicant: Purem GmbH, Neunkirchen (DE)

(72) Inventors: Enver Kurpejovic, Kirchheim unter Teck (DE); Fatih Uysal, Plochingen (DE); Holger Prommersberger, Korntal-Muenchingen (DE); Dietmar Kuschel, Murr (DE); Sandra Hoeckel, Esslingen (DE)

(73) Assignee: Purem GmbH, Neunkirchen (DE)

( * ) Notice: Subject to any disclaimer, the term of this patent is extended or adjusted under 35 U.S.C. 154(b) by 0 days.

(21) Appl. No.: 17/241,423

(22) Filed: Apr. 27, 2021

(65) Prior Publication Data

US 2021/0332728 A1 Oct. 28, 2021

(30) Foreign Application Priority Data

Apr. 27, 2020 (DE) ..... 10 2020 111 428.1

(51) Int. Cl.
*F01N 3/00* (2006.01)
*F01N 3/20* (2006.01)
*F01N 13/14* (2010.01)

(52) U.S. Cl.
CPC ..... *F01N 3/2013* (2013.01); *F01N 13/14* (2013.01); *F01N 2240/16* (2013.01)

(58) Field of Classification Search
CPC .... F01N 3/2013; F01N 13/14; F01N 2240/16; F01N 3/027
See application file for complete search history.

(56) References Cited

U.S. PATENT DOCUMENTS 5,317,869 A * 6/1994 Takeuchi ..... F01N 3/2814 422/174
5,571,485 A * 11/1996 Brunson ..... B01D 53/9454 422/174
5,670,746 A * 9/1997 Hashimoto ..... H01R 13/73 174/651
5,935,473 A * 8/1999 Hashimoto ..... F01N 3/2026 219/541
6,031,213 A * 2/2000 Hashimoto ..... H05B 3/08 219/541

(Continued)

FOREIGN PATENT DOCUMENTS

EP 0 716 558 A2 6/1996
EP 2 935 996 A1 10/2015
WO 2020/203859 A1 10/2020

OTHER PUBLICATIONS

U.S. Appl. No. 16/951,816, filed Nov. 18, 2020 (corresponds to DE102019131556—unpublished).

*Primary Examiner* — Matthew T Largi
(74) *Attorney, Agent, or Firm* — Walter Ottesen, P.A.

(57) ABSTRACT

A connection unit for an exhaust gas heater in an exhaust gas system of a combustion engine includes an electrically conducting connection element, elongated in the direction of a connection element longitudinal axis (L). The connection element has an inner connection region for connection to a heating conductor and an outer connection region for connection to an electrical supply. A carrier arrangement surrounds the connection element and an insulating arrangement insulates the connection element with respect to the carrier arrangement.

15 Claims, 4 Drawing Sheets

(56) References Cited

U.S. PATENT DOCUMENTS

| | | | | |
|---|---|---|---|---|
| 6,176,081 | B1 * | 1/2001 | Shimasaki | F01N 3/2026 60/300 |
| 9,225,107 | B2 * | 12/2015 | Hirth | F01N 3/027 |
| 9,393,521 | B2 * | 7/2016 | Brueck | B01D 53/885 |
| 10,415,447 | B2 * | 9/2019 | Schlipf | F01N 3/2013 |
| 10,677,126 | B2 * | 6/2020 | Schlipf | H05B 3/48 |
| 10,801,388 | B2 | 10/2020 | Culbertson et al. | |
| 10,941,688 | B2 * | 3/2021 | Hirth | F01N 3/027 |

* cited by examiner

CONNECTION UNIT FOR AN EXHAUST GAS HEATER

CROSS REFERENCE TO RELATED APPLICATION

This application claims priority of German patent application no. 10 2020 111 428.1, filed Apr. 27, 2020, the entire content of which is incorporated herein by reference.

TECHNICAL FIELD

The present invention relates to a connection unit for an exhaust gas heater in an exhaust gas system of a combustion engine.

BACKGROUND

An exhaust gas heater arranged in a tubular exhaust gas routing component of an exhaust gas system is known from post-published German patent application DE 10 2019 131 556 (corresponding to U.S. application Ser. No. 16/951,816, filed Nov. 18, 2020, and incorporated herein by reference). The exhaust gas heater comprises a plate-like carrier carried in the exhaust gas routing component and a spirally wound heating conductor on one side of the plate-like carrier. In order to supply the heating conductor with electrical energy, the two connection ends of the heating conductor must be connected to respective electrical supply lines.

SUMMARY

An object of the present invention is to provide a connection unit for an exhaust gas heater in an exhaust gas system of a combustion engine with which an electrical connection with a heating conductor of the exhaust gas heater can be established simply and reliably. The heating conductor is arranged inside an exhaust gas routing component of an exhaust gas system This object is achieved according to the invention by a connection unit for an exhaust gas heater in an exhaust gas system of a combustion engine, comprising:

- an electrically conducting connection element, elongated in the direction of a connection element longitudinal axis, having an inner connection region for connection to a heating conductor and an outer connection region for connection to an electrical supply line,
- a carrier arrangement which surrounds the connection element,
- an insulating arrangement which insulates the connection element with respect to the carrier arrangement.

Such a connection unit, while being of simple construction, provides the possibility of electrically contacting a heating conductor inside an exhaust gas routing component but at the same time electrically insulating the heating conductor, or the connection element, with respect to the exhaust gas routing component, which is generally constructed from sheet-metal material, and establishing a gas-tight connection between the connection element and the exhaust gas routing component.

In order to be able to produce in a simple manner on the one hand the electrical connection to a heating conductor and on the other hand the electrical connection to a supply line running outside the exhaust gas system, it is proposed that the inner connection region is provided at a first longitudinal end of the connection element and the outer connection region is provided at a second longitudinal end of the connection element, or/and that the outer connection region comprises an external thread, or/and that the inner connection region comprises a heating conductor receiving opening.

An embodiment that is advantageous both with regard to the electrical insulation that is to be achieved and with regard to the gas-tight connection that is to be achieved can provide that the connection element comprises, between the inner connection region and the outer connection region, an insulating arrangement support region which is held on the carrier arrangement by means of the insulating arrangement.

A stable holding interaction is thereby assisted in that the insulating arrangement support region comprises a first holding portion which widens radially in the direction away from the inner connection region towards the outer connection region, and a second holding portion which widens radially in the direction away from the outer connection region towards the first holding portion.

For a compact construction in the longitudinal direction of the connection element it can be provided that the first holding portion and the second holding portion adjoin one another in their axial end regions of maximum radial dimension, or/and that the first holding portion or/and the second holding portion is configured so as to widen radially substantially conically.

The insulating arrangement can comprise at least one insulating sleeve surrounding the connection element.

In adaptation to the radially widening shaping, provided for stable holding, of the connection element, the insulating arrangement is preferably so configured that it comprises a first insulating sleeve in association with the first holding portion and a second insulating sleeve in association with the second holding portion.

In order to ensure a stable holding interaction via the insulating arrangement both in respect of the connection element and in respect of the carrier arrangement, the first insulating sleeve can be configured in an inner circumferential region and an outer circumferential region so as to widen radially in the direction towards the second insulating sleeve, and the second insulating sleeve can be configured in an inner circumferential region and an outer circumferential region so as to widen radially in the direction towards the first insulating sleeve.

In adaptation to the shaping of the connection element, the first insulating sleeve or/and the second insulating sleeve is preferably configured in its inner circumferential region and its outer circumferential region so as to widen radially substantially conically.

When the at least one insulating sleeve is constructed with ceramics material or mica material, a connection between the connection element and the carrier arrangement that ensures mechanically stable, electrically insulating and also gas-tight termination is achieved.

The carrier arrangement can comprise a first carrier element, which is to be fixed to an exhaust gas system, and a second carrier element, which together with the first carrier element clamps the connection element.

In adaptation to the radially widening shaping of the connection element, the first carrier element can comprise, in association with the first holding portion, a first carrying portion which widens radially in the direction towards the second carrier element, and the second carrier element can comprise, in association with the second holding portion, a second carrying portion which widens radially in the direction towards the first carrier element. In particular, it can thereby be provided that, in the case of a conical form of the two holding portions of the connection element, the first carrying portion or/and the second carrying portion is configured so as to widen radially substantially conically.

It can thereby be provided that the first carrying portion surrounds the first holding portion with the interposition of the first insulating sleeve, and that the second carrying portion surrounds the second holding portion with the interposition of the second insulating sleeve.

For stable holding of the connection element between the two carrier elements it is proposed that the first carrier element is coupled with the second carrier element so that they are axially displaceable relative to one another. This can be achieved, for example, in that the first carrier element is coupled with the second carrier element by thread engagement. By rotation of the two carrier elements with respect to one another, they are displaced axially with respect to one another, whereby firm clamping of the connection element with the interposition of the insulating arrangement is achieved.

The invention relates further to an exhaust gas system for a combustion engine, comprising an exhaust gas routing component, an exhaust gas heater, arranged in the exhaust gas routing component, having a heating conductor and, in association with at least one, preferably each connection end of the heating conductor, a connection unit constructed according to the invention.

BRIEF DESCRIPTION OF THE DRAWINGS

The invention will now be described with reference to the drawings wherein.

DESCRIPTION OF THE PREFERRED EMBODIMENTS

Figure 1:
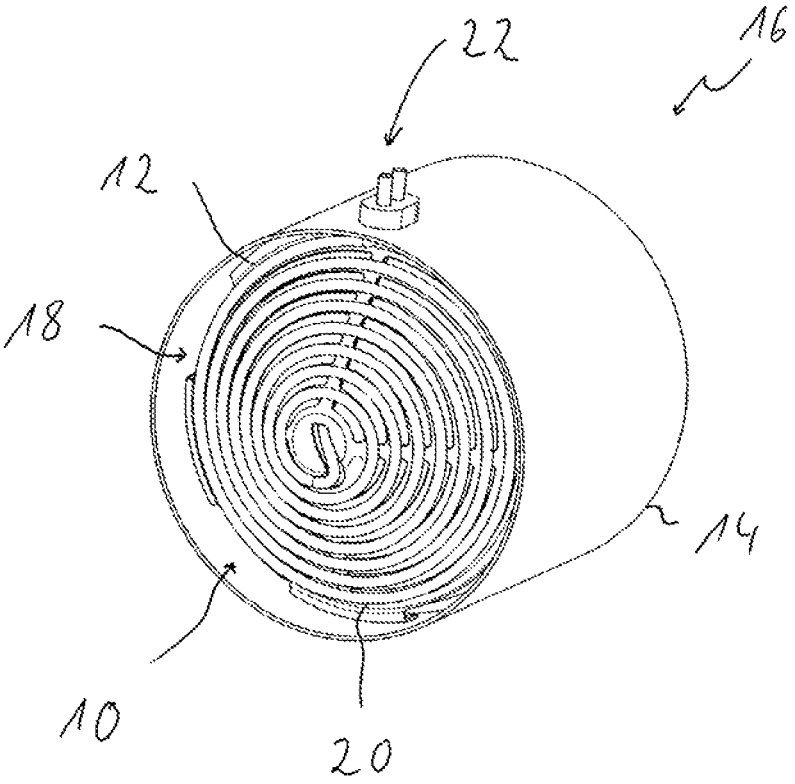
FIG. 1 is a perspective view of an exhaust gas heater arranged in an exhaust gas routing component of an exhaust gas system.

FIG. 1 shows an exhaust gas heater 10 known, for example, from German patent application DE 10 2019 131 556 (corresponding to U.S. application Ser. No. 16/951,816, filed Nov. 18, 2020, and incorporated herein by reference). The exhaust gas heater 10 comprises a carrier 12 of disk-like, for example conical, shape which is constructed, for example, of sheet-metal material and integrated into a tubular exhaust gas routing component 14 of an exhaust gas system designated generally 16. On one side of the carrier 12 there is provided a spirally wound heating region 18 of a heating conductor designated generally 20. The heating region 18 of the heating conductor 20, which heating region is not electrically insulated, for example, at least in part and is held on the carrier 12, warms up when electrical current is applied and thereby warms the exhaust gas which is to flow, for example, in the direction towards a catalytic converter arrangement or other exhaust gas treatment unit.

In order to supply the heating conductor 20 with electrical energy there is provided in the construction of an exhaust gas system shown in FIG. 1 a connection assembly 22 shown schematically. The connection assembly 22 can comprise, according to the principles of the present invention, two connection units 24 described in detail hereinbelow with reference to FIGS. 2 to 4. Each of the connection units 24 is electrically conductively connected to one of the two connection ends of the heating conductor 20 and provides the possibility of establishing a connection to a corresponding electrical supply line outside the exhaust gas routing component.

Figure 2:
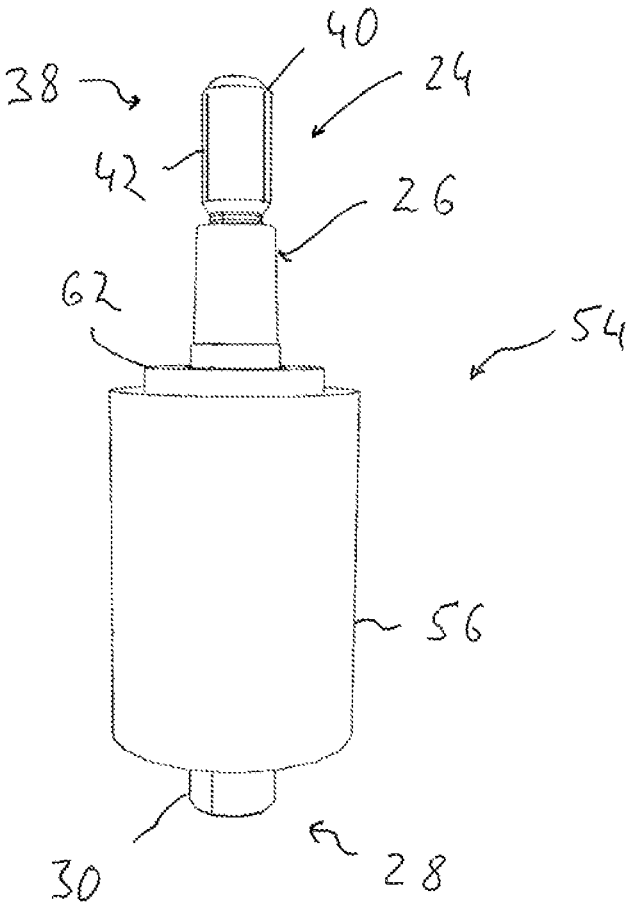
FIG. 2 is a side view of a connection unit for a heating conductor of an exhaust gas heater.
Figure 3:
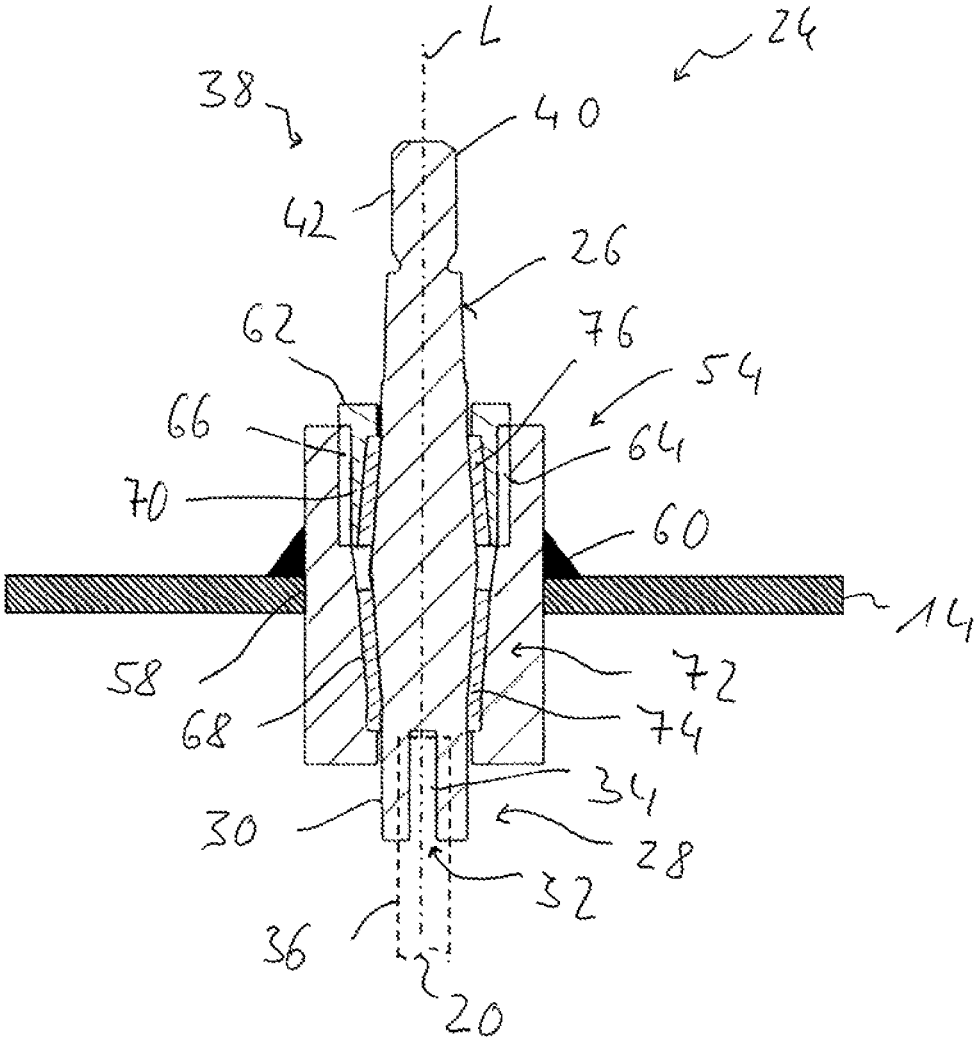
FIG. 3 is a sectional view of the connection unit of FIG. 2 integrated into an exhaust gas routing component; and, FIG. 4 is a side view of a connection element of the connection unit of FIG. 2.
Figure 4:
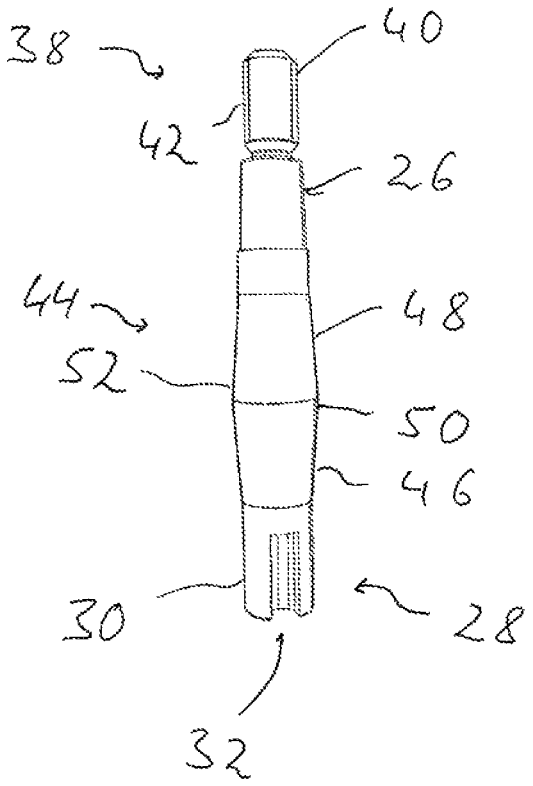

The connection unit 24 shown in FIGS. 2 to 4 includes as the central component a connection element 26 which is made, for example, of steel material and thus configured so as to be electrically conducting. The connection element 26 is preferably in one piece. The connection element 26 has, at a first longitudinal end 28 of the connection element 26 with respect to a connection element longitudinal axis L, an inner connection region 30. The inner connection region 30 can include, for example, a heating conductor receiving opening 32 and can be slotted, that is, formed, for example, with two notches 34. A connection end 36 of the heating conductor 20 is pushed into the heating conductor receiving opening 32. The connection element 26 can then be squeezed together, that is, compressed, in its inner connection region 30, whereby the connection end 36 of the heating conductor 20 is fixedly anchored to the connection element 26. Alternatively or in addition, this fixed connection can take place by substance-to-substance bonding, such as, for example, welding or soldering.

At its second longitudinal end 38 in the direction of the connection element longitudinal axis L, the connection element 26 has an outer connection region 40. The outer connection region 40 can be constructed, for example, with an external thread 42 onto which there can be screwed a nut which produces a fixed connection of an electrical supply line.

Between the inner connection region 30 and the outer connection region 42, the connection element 26 has an insulating arrangement support region designated generally 44. In the insulating arrangement support region 44, the connection element 26 has two holding portions 46, 48 which, with respect to the connection element longitudinal axis L, widen axially towards one another, or away from a longitudinal end 28, 38 located nearer in each case. For example, the two holding portions 46, 48 are formed with a conical outer circumferential contour and adjoin one another directly in their end regions 50, 52 of maximum external dimension. Alternatively, a cylindrical portion of the connection element 26, for example, that is, a portion in which the connection element 26 has an approximately constant radial dimension, could be positioned between the end region 50 of maximum external dimension of the first holding portion 46 and the end region 52 of maximum radial dimension of the second holding portion 48.

For fixing the connection unit 24 to the exhaust gas routing component 14, a carrier arrangement designated generally 54 is provided. The carrier arrangement 54 comprises a bush-like or sleeve-like first carrier element 56 of metal material, for example steel material, which is inserted into an opening 58 of the exhaust gas routing component 14 and fixed thereto in a stable and gas-tight manner by a welded joint 60.

The carrier arrangement 54 further comprises a second bush- or sleeve-like carrier element 62 which is inserted into the end of the first carrier element 56 located outside the exhaust gas routing component 14 and connected thereto by thread engagement. For this purpose, the first carrier element 56 has an internal thread 64 substantially in its length region positioned outside the exhaust gas routing component 14, while the second carrier element 62 can be formed with an external thread 66 in its length region that is to be positioned so that it threadably engages into the first carrier element 56.

By screwing the second carrier element 62 into the first carrier element 56, the axial positioning of the second carrier element 62 with respect to the first carrier element 56 is changed.

In adaptation to the radially widening form of the first holding portion 46 of the connection element 26, the first carrier element 56 has a radially widening first carrying portion 68. The first carrying portion 68 can be of a complementary shape to the first holding portion 46, that is, for example, be configured so as to widen conically at least in the greater part of its longitudinal extent. In the assembled state, the first carrying portion 68 substantially surrounds the first holding portion 46.

The second carrier element 62 has, in adaptation to the second holding portion 48, a second carrying portion 70. The second carrying portion 70 is configured, in accordance with the shaping of the second holding portion 48, so as to widen radially conically and surrounds the second holding portion 48.

For establishing gas-tight, electrically insulating holding interaction between the connection element 26 and the carrier arrangement 54, an insulating arrangement designated generally 72 is provided. The insulating arrangement includes a first insulating sleeve 74 in association with the first holding portion 46, or with the first carrying portion 68, and a second insulating sleeve 76 in association with the second carrying portion 70, or with the second holding portion 48. Adapted to the shaping of the two holding portions 46, 48, or of the carrying portions 68, 70 surrounding them, the two insulating sleeves 74, 76 are configured in their inner circumferential regions and their outer circumferential regions so as to widen radially towards one another, in particular also so as to widen radially conically. The first insulating sleeve 74 can have, for example, in its end region located near to the first longitudinal end 28 of the connection element 26 an approximately cylindrical end portion which surrounds the first longitudinal end 28, which adjoins the first holding portion 46, and can likewise have, for example, a cylindrical outer circumferential contour, and is surrounded on the outside by a correspondingly cylindrically shaped axial end region of the first carrying portion 68.

With the interposition of the two insulating sleeves 74, 76, which can have approximately constant wall thicknesses in the axial direction, the connection element 26 is on the one hand supported radially with respect to the first carrier element 56 and the second carrier element 62 and, owing to the shaping of the two holding portions 46, 48 widening radially towards one another and the complementary shaping of the two carrying portions 68, 70, is also held positively on the carrier arrangement 54 in the axial direction. Since the shaping of the two insulating sleeves 74, 76 is adapted in the inner circumferential region to the shaping of the two holding portions 46, 48 and in the outer circumferential region to the shaping of the two carrying portions 68, 70, the two insulating sleeves 74, 76 constructed, for example, from ceramics material or mica material not only provide electrical insulation of the connection element 26 with respect to the carrier arrangement 54 but, owing to the exact fit, also achieve a gas-tight connection between the connection element 26 and the carrier arrangement 54.

Stable holding is achieved or assisted in particular in that, after the connection element 26 has been inserted, with the interposition of the first insulating sleeve 74, into the first carrier element 56 and the second insulating sleeve 76 has been applied to the second holding portion 48, the second carrier element 62 is pushed onto the connection element 26 and screwed into the first carrier element 56. The second carrier element 62 thereby moves axially towards the inner connection region 30 of the connection element 26 and thus positively clamps the connection element 26 stably into the carrier arrangement 54. After this state has been reached, the second carrier element 62 can be connected to the first carrier element 56, for example by substance-to-substance bonding, such as, for example, adhesive bonding or welding, in order to prevent loosening of this state.

It is understood that the foregoing description is that of the preferred embodiments of the invention and that various changes and modifications may be made thereto without departing from the spirit and scope of the invention as defined in the appended claims.

What is claimed is:

1. A connection unit for an exhaust gas heater in an exhaust gas system of a combustion engine, the connection unit comprising:

a connection element being electrically conductive and defining a longitudinal axis (L) and being elongated along said longitudinal axis (L);

said connection element having an inner connection region for connecting to a heating conductor and an outer connection region for connecting to an electric supply;

a carrier arrangement surrounding said connection element; and, an insulating arrangement insulating said connection element with respect to said carrier arrangement;

wherein said connection element has a support region between said inner connection region and said outer connection region for accommodating said insulating arrangement; and said support region is held on said carrier arrangement via said insulating arrangement, said support region comprising:

a first holding portion widening radially in a direction away from said inner connection region toward said outer connection region; and, a second holding portion widening radially in a direction away from said outer connection region toward said first holding portion; wherein said carrier arrangement comprises:

a first carrier element configured so as to be fixed into the exhaust gas system; and, a second carrier element configured so as to cause said first and second carrier elements to conjointly clamp said connection element, said first carrier element defining a first carrying portion corresponding to said first holding portion and widening radially in a direction toward said second carrier element; and said second carrier element defining a second carrying portion corresponding to said second holding portion and widening radially in a direction toward said first carrier element.

2. The connection unit of claim 1, wherein said connection element has a first longitudinal end whereat said inner connection region is disposed and a second longitudinal end whereat said outer connection region is disposed.

3. The connection unit of claim 1, wherein at least one of:

said outer connection region comprises an external thread; and, said inner connection region defines a receiving opening for receiving the heating conductor therein.

4. The connection unit of claim 1, wherein at least one of:

said first holding portion and said second holding portion mutually adjoin in their axial end regions of maximum radial dimension;

said first holding portion is configured so as to widen radially in a substantially conical manner; and, said second holding portion is configured so as to widen radially in a substantially conical manner.

5. The connection unit of claim 1, wherein said insulating arrangement comprises at least one insulating sleeve surrounding said connection element.

6. The connection unit of claim 5, wherein said insulating sleeve is made with ceramic material or mica material.

7. The connection unit of claim 1, wherein said insulating arrangement comprises a first insulating sleeve associated with said first holding portion and a second insulating sleeve associated with said second holding portion.

8. The connection unit of claim 7, wherein said first insulating sleeve is configured to have an inner circumferential region and an outer circumferential region so as to widen radially in a direction toward said second insulating sleeve; and, said second insulating sleeve is configured in an inner circumferential region and an outer circumferential region so as to widen radially in a direction toward the first insulating sleeve.

9. The connection unit of claim 8, wherein the at least one of said first and second insulating sleeves has an inner circumferential region and outer circumferential region widening radially in a substantially conical manner.

10. The connection unit of claim 1, wherein at least one of said first and second carrying portions is configured to widen radially substantially conically.

11. The connection unit of claim 1, wherein said insulating arrangement comprises a first insulating sleeve associated with said first holding portion and a second insulating sleeve associated with said second holding portion; said first carrying portion surrounds said first holding portion to conjointly define a first interface therebetween; said first insulating sleeve is disposed at said first interface; said second carrying portion surrounds said second holding portion to conjointly define a second interface therebetween; and, said second insulating sleeve is disposed at said second interface.

12. The connection unit of claim 11, wherein said first and second carrier elements are mutually coupled so as to permit said carrier elements to be displaceable relative to each other.

13. The connection unit of claim 12, wherein said first and second carrier elements are mutually coupled by a threaded connection.

14. An exhaust gas system for a combustion engine, the exhaust gas system comprising:

an exhaust gas guide component for conducting a flow of exhaust gas; and, an exhaust gas heater mounted in said exhaust gas guide component;

said exhaust gas heater including a heating conductor having first and second ends;

a connection unit mounted in said exhaust gas guide component;

said connection unit including:

a connection element being electrically conductive and defining a longitudinal axis (L) and being elongated along said longitudinal axis (L);

said connection element having an inner connection region connected to one of said ends of said heating conductor and an outer connection region for connecting to an electric supply;

a carrier arrangement surrounding said connection element; and, an insulating arrangement insulating said connection element with respect to said carrier arrangement;

wherein said connection element has a support region between said inner connection region and said outer connection region for accommodating said insulating arrangement; and said support region is held on said carrier arrangement via said insulating arrangement, said support region comprising:

a first holding portion widening radially in a direction away from said inner connection region toward said outer connection region; and, a second holding portion widening radially in a direction away from said outer connection region toward said first holding portion; wherein said carrier arrangement comprises:

a first carrier element fixed into the exhaust gas system; and, a second carrier element configured so as to cause said first and second carrier elements to conjointly clamp said connection element, said first carrier element defining a first carrying portion corresponding to said first holding portion and widening radially in a direction toward said second carrier element; and said second carrier element defining a second carrying portion corresponding to said second holding portion and widening radially in a direction toward said first carrier element.

15. The exhaust gas system of claim 14, further comprising an additional connection unit corresponding to said connection unit and wherein the inner connection region of the connection element of said additional connection unit is connected to the other end of said heating conductor.

* * * * *